United States Patent [19]

Einbinder

[11] 4,332,493

[45] Jun. 1, 1982

[54] TEN-FINGER TYPEWRITER KEYBOARDS

[76] Inventor: Harvey Einbinder, 308 W. 97 St., New York, N.Y. 10025

[21] Appl. No.: 158,944

[22] Filed: Jun. 12, 1980

[51] Int. Cl.[3] ..... B41J 5/10

[52] U.S. Cl. ..... 400/484; 400/486; 400/489

[58] Field of Search ..... 400/484, 486, 488, 489

[56] References Cited

U.S. PATENT DOCUMENTS

| | | | |
|---|---|---|---|
| 1,468,566 | 9/1923 | Hall | 400/486 X |
| 2,040,248 | 5/1936 | Dvorak et al. | 400/486 |
| 2,080,457 | 5/1937 | Bower | 400/486 X |
| 2,102,526 | 12/1937 | Guilfoyle | 400/489 X |
| 2,120,174 | 6/1938 | Estes | 400/486 |
| 2,369,807 | 2/1945 | Solon | 400/489 X |
| 3,319,884 | 5/1967 | Franklin | 235/145 |
| 3,929,216 | 12/1975 | Einbinder | 400/489 |
| 3,945,482 | 3/1976 | Einbinder | 400/486 |
| 3,997,047 | 12/1976 | Wolowitz | 400/697.1 |
| 4,244,659 | 1/1981 | Malt | 400/486 |

FOREIGN PATENT DOCUMENTS

| | | | |
|---|---|---|---|
| 664838 | 9/1938 | Fed. Rep. of Germany | 400/484 |
| 2017063 | 10/1970 | Fed. Rep. of Germany | 400/486 |
| 615542 | 1/1949 | United Kingdom | 400/486 |
| 700083 | 11/1953 | United Kingdom | 400/486 |

OTHER PUBLICATIONS

*IBM Tech. Disc. Bulletin,* by D. L. Conway, vol. 22, No. 3, Aug. 1979, pp. 1276–1277.

*IBM Tech. Disc. Bulletin,* by C. P. Ludeman, vol. 19, No. 8, Jan. 1977, pp. 2860–2864.

*Die Schreibmachine und ihr Entwicklungsgeschicht,* 1949, by Ernst Martin, pp. 530–543.

*Primary Examiner*—Paul T. Sewell

[57] ABSTRACT

Typewriter keyboards for English and German are disclosed that assign vowels and consonants to keys on both sides of the keyboard to maximize the number of successive keystrokes by the same hand and to minimize the number of successive keystrokes by the same finger. Three high frequency vowels and two high frequency consonants are assigned to home keys that lie directly under the fingers of the left hand. Three high frequency consonants, a high frequency vowel, and the space are assigned to home keys that lie directly under the fingers of the right hand. A single elevated case shift key is located on the left hand end of the lower letter key row. The elevated stroking surface of the carriage return key is located at the right hand ends of the lower letter key row and the home key row. Steeply inclined key tops slope down toward neighboring home keys to guide fingers to the proper home position and to facilitate actuating non-home keys.

12 Claims, 17 Drawing Figures

German

TEN-FINGER TYPEWRITER KEYBOARDS

BACKGROUND OF THE INVENTION

This invention relates to keyboards for electric typewriters, cathode ray terminals, word processing equipment, and other devices that use a keyboard to transfer natural language texts to a machine.

An earlier U.S. Pat. No. 3,929,216 discusses the limiations of the universal ("qwerty") typewriter keyboard, and the linguistic and kinesthetic factors governing keyboard design. Curilinear keyboards are revealed in this patent for six languages based on the statistical properties of character sequences occuring in these languages. A second U.S. Pat. No. 3,945,482 discloses curvilinear keyboards for eight languages that employ vertically oriented keys which are assigned medium frequency characters.

The keyboards disclosed in these patents ignore the traditional spacial location of keys on the standard keyboard, and assign vowels and consonants to opposite sides of the keyboard to minimize the number of successive strokes made by the same hand. Experimental observation indicates, however, that keyboard learning can be accelerated by placing vowels and consonants on both sides of the keyboard to maximize the number of successive strokes made by the same hand. Furhermore, the expense of introducing a new keyboard may be reduced by retaining the straight parallel key rows and key locations used on the standard keyboard.

SUMMARY OF THE INVENTION

Accordingly, an object of this invention is to disclose keyboards for English and German containing straight parallel key rows in which different high frequency letters are assigned to eight home keys in the home key row and to one home key in the lower letter key row.

Another object of this invention is to disclose keyboards that employ an elevated case shift key and an elevated carriage return key that can be operated without removing fingers from home keys.

Another object of this invention is to disclose keyboards that utilize steeply inclined character key tops that face neighboring home keys.

Another object of this invention is to disclose a keyboard for correcting typewriters that utilizes a correction key and a backspace key that are suituated in the space bar key row.

A final object of this invention is to disclose a keyboard for word processing equipment that utilizes a code key and a backspace key that are situated in the space bar key row.

Accordingly, to reduce the cost of introducing a new keyboard, the straight parallel key rows of the standard keyboard are retained on the English and German keyboards of this invention. Vowels and consonants are distributed on both sides of the keyboard to maximize the number of successive keystrokes by the same hand and to minimize the number of successive keystrokes by the same finger. The greater dexterity of the right hand is utilized by assigned more keystrokes to the right hand than to the left hand.

The stroking power of both thumbs is utilized by assigning the right thumb to actuate the space key, and the left thumb to actuate a high frequency vowel in the lower letter key row. The greater dexterity of the right hand is utilized by assigning the commonest consonant and the commonest vowel to home keys on the right hand side of the keyboard. Eight high frequency vowels and consonants are assigned to adjacent keys in the home key row to maximize the number of successive strokes by the same hand to maximize the number of successive strokes on adjacent home keys. Character are distributed on other keys to avoid awkward stroking motions by fingers of the same hand and to minimize the number of successive strokes by the same finger.

Steeply inclined character key tops face neighboring home key tops to guide fingers to the proper home position, and to allows steeply inclined character keys to be actuated by bending or straightening fingers resting on neighboring home keys. To compensate for differences in finger length, home keys assigned to the little finger and the forefinger are taller than homes keys assigned to the middle finger and the ring finger.

The keyboards of this invention employ a single case shift key possessing an elevated stroking surface situated at the left hand end of the lower letter key row, and a carriage return key posesses an elevated stroking surface situated at the right hand ends of the home key row and the lower letter key row. These elevated stroking surfaces allow the case shift key and the carriage return key to be actuated by rotating the wrist without removing fingers from home keys. An alternate keyboard is disclosed that utilizes a backspace key situated at the right hand end of the home key row, and an elevated carriage return key situated at the right hand end of the lower letter key row. Another keyboard is disclosed for correcting typewriters that utilizes a correction key and a backspace key that are situated in the space bar row. Another keyboard is disclosed for word processing equipment that utilizes a code key and a backspace key that are situated in the space bar row.

DESCRIPTION OF THE INVENTION

Figures 1, 2, 3:
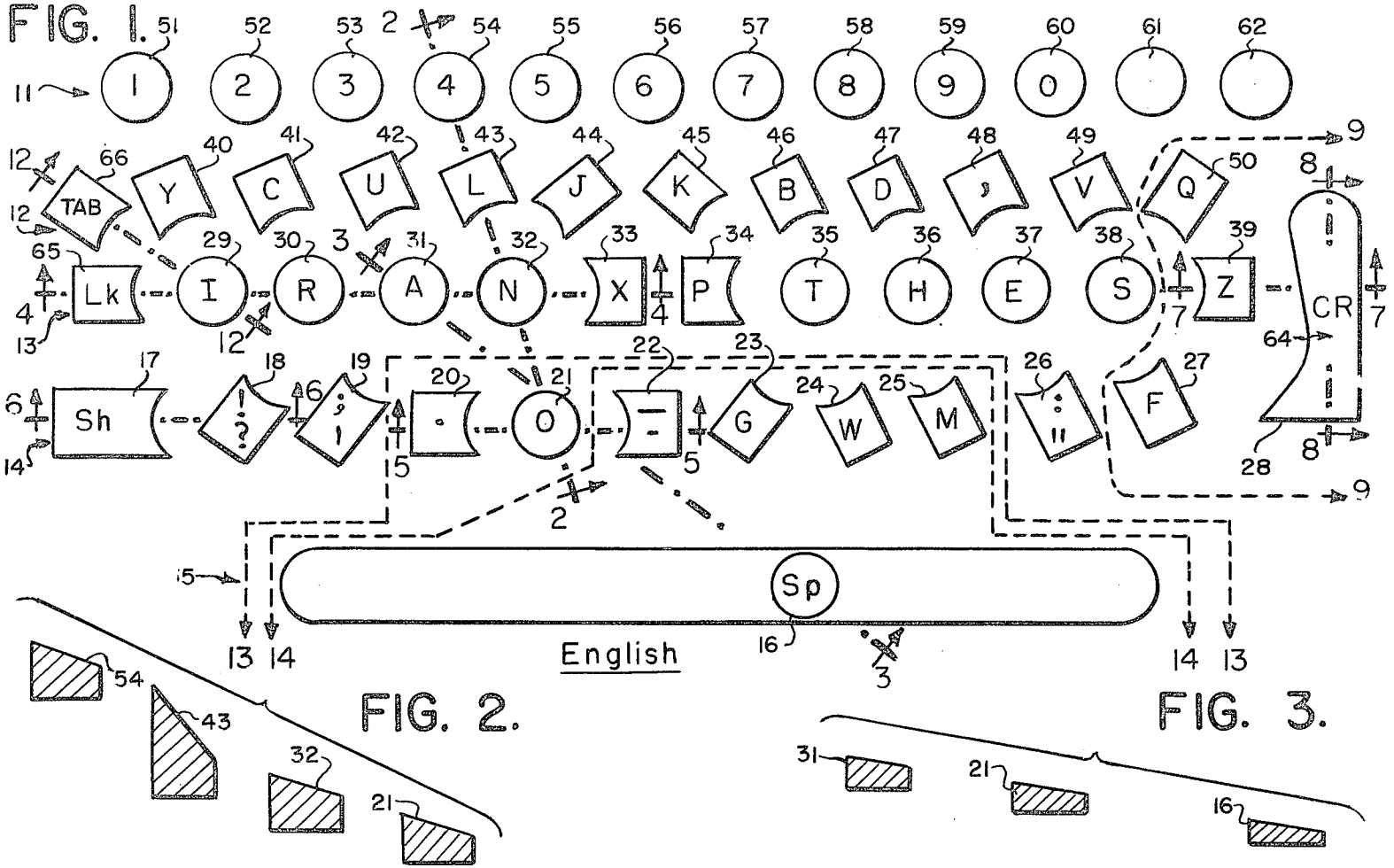
FIG. 1 is a top view of part of the ten-finger keyboard for the English language, illustrating the location of the most important characters, the inclined stroking surfaces of character keys, and the location of the case shift key and the carriage return key.
FIG. 2 is a cross-section taken along the line 2—2 of FIG. 1, illustrating the stroking surfaces of character keys in different key rows.
FIG. 3 is a cross section taken along the line 3—3 of FIG. 1, illustrating the slightly inclined key tops of home keys in the home key row, the lower letter key row, and the space bar row.

To facilitate input, the stroking surfaces of the standard electric typewriter keyboard are modified on the keyboards of this invention, but the conventional spacial location of the connection between keys and the internal mechanism of the machine to which the keyboard is attached is retained. The geometric modification of the stroking surfaces may be clarified by referring to the drawings.

FIG. 1 is a top view of part of the ten-finger keyboard for the English language, illustrating the arrangement of keys in straight, parallel key rows. The space bar row 15 is situated nearest to the operator, followed by the lower letter key row 14, then by the home key row 13, then by the upper letter key row 12, and then by the number key row 11, which is farthest from the operator.

Figure 4:
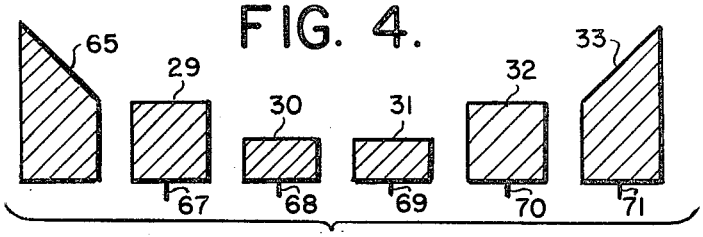
FIG. 4 is a cross-section taken along the line 4—4 of FIG. 1, illustrating the stroking surfaces of character keys in the home key row and the connection between the said character keys and the internal mechanism of the typewriter.

As illustrated by keys 16, 21, 29, 30, 31, 32, 54 in FIGS. 2, 3, 4, key tops of character keys 16, 21,29, 30, 31, 32, 35, 36, 37, 38, 51, 52, . . . 61, 62, designed by circles in FIG. 1, face the operator and are slightly inclined with respect to the base of the machine to which the keyboard is attached.

As illustrated by keys 29, 30, 31, 32 in FIG. 4, key tops of home keys 29, 38 assigned to the little finger and key tops of home keys 32, 35 assigned to the forefinger have the same height, and are taller than key tops of home keys 30, 37 assigned to the ring finger and key tops of home keys 31, 36 assigned to the middle finger, which have the same height, when the height of the said key tops are measured by the vertical distance separating the center of the said key tops from the base of the machine to which the keyboard is attached. Using two different heights for key tops of home keys in the home key row compensates for differences in finger length. Utilizing one height for home keys assigned to the little finger and the forefinger, and another height for home keys assigned to the ring finger and the middle finger, is a practical compromise between the uniform height for home keys employed on the standard keyboard, and four different heights, one for each finger, which have been proposed by earlier inventors.

To facilitate operating keys on the right hand side of the keyboard, the space key 16 is situated on the right hand side of the space bar row 15, located between the operator and keys 23, 24 in the lower letter key row 14. As illustrated by keys 16, 21, 32, in FIGS. 2, 3, 4, key tops of home keys 16, 21, 29, 32, 35, 38 are situated in a common inclined plane that slopes down toward the operator. As illustrated by keys 30, 31 in FIGS. 3, 4, key tops of home keys 30, 31, 36, 37 are situated in a common inclined plane that slopes down toward the operator. This said inclined plane is situated between the base of the machine to which the keyboard is attached and the inclined plane that is tangent to key tops of home keys 16, 21, 29, 32, 35, 38.

On the keyboards of this invention, fingers normally rest on the space key 16 and the nine character home keys 21, 29, 30, 31, 32, 35, 36, 37, 38. The left thumb of the operator rests on home key 21 situated on the left hand side of the lower letter key row 14. The four other bent fingers of the left hand rest on four adjacent home keys 29, 30, 31, 32, situated on the left hand side of the home key row 13, as viewed by the operator. The right thumb of the operator rests on the space key 16, which generates the space separating words. The four other bent fingers of the right hand rest on four adjacent home keys 35, 36, 37, 38 on the right hand side of the home key row 13, as viewed by the operator.

Character keys 18, 19, 20, 22, 23, . . . , 26, 27, 33, 34, 39, 40, . . . , 49, 50 adjacent to the home keys 21, 29, 30, 31, 32, 35, 36, 37, 38 possess steeply inclined stroking surfaces that slope down toward the said neighboring home keys 21, 29, 30, 31, 32, 35, 36, 37, 38 to guide fingers to the proper home position, and to permit the said steeply inclined stroking surfaces to be actuated by bending or straightening fingers resting on the said home keys.

The steeply inclined stroking surfaces of character keys 18, 19, 20, 22, 23, . . . , 26, 27, 33, 34, 39, 40, . . . , 49, 50 are represented in FIG. 1 by a rectangular box containing a curved arc indicating the location and orientation of the steeply inclined stroking surface of the said character keys. The neighboring home keys 29, 30, 31, 32, 35, 36, 37, 38 in the home key row 13 and the neighboring home key 21 in the lower letter key row 14 are represented by circles in FIG. 1.

Figure 5:
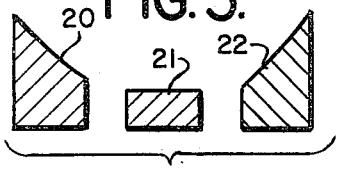
FIG. 5 is a cross-section taken along the line 5—5 of FIG. 1, illustrating the stroking surfaces of character keys in the lower letter key row.

As illustrated in FIGS. 1, 2, 5, seven steeply inclined character keys 18, 19, 23, 24, 25, 26, 27 in the lower letter key row 14 face six neighboring home keys 30, 31, 35, 36, 37, 38 in the home key row 13 in the direction that fingers resting on the said home keys in the home key row 13 move to actuate the said steeply inclined character keys in the lower letter key row 14. When fingers resting on the home keys 30, 31, 36, 37, 38 are bent toward the palm, they strike the steeply inclined neighboring keys 18, 19, 25, 26, 27, respectively, in the lower letter key row 14, and impart a vertical force that actuates the said steeply inclined keys. When the right forefinger, which rests on home key 35 is bent toward the palm, it actuates two steeply inclined keys 23, 24 in the lower letter key row.

As illustrated in FIG. 5, two steeply inclined keys 20, 22 in the lower letter key row 14 slope down toward the home key 21 in the lower letter key row. When the left thumb resting on the home key 21 is bent toward the palm, it actuates key 20, and when the left thumb is straightened, it actuates key 22.

As illustrated in FIG. 1 and by keys 32, 43 in FIG. 2, eleven character keys 40, 41, . . . , 49, 50 in the upper letter key row 12 face eight neighboring home keys 29, 30, 31, 32, 35, 36, 37, 38 in the home key row 13 and are steeply inclined with respect to the base of the machine to which the keyboard is attached. When fingers resting on home keys 29, 30, 31, 36, 37 are straightened, they actuate the neighboring steeply inclined keys 40, 41, 42, 47, 48, respectively, in the upper letter key row 12. When the left forefinger, which rests on home key 32, is straightened, it actuates two steeply inclined keys 43, 44 in the upper letter key row 12, and when the left forefinger is bent along the home key row 13, it actuates a steeply inclined key 33 in the home key row 13. When the right forefinger, which rests on home key 35, is straightened, it actuates two steeply inclined keys 45, 46 in the upper letter key row 12, and when the right forefinger is bent along the home key row 13, it actuates a steeply inclined key 34 in the home key row 13. When the right little finger, which rests on home key 38, is straightened, it actuates two steeply inclined keys 49, 50 in the upper letter key row 12, and when the right little finger is bent along the home key row 13, it actuates a steeply inclined key 39 in the home key row 13 whose stroking surface faces the adjacent home key 38.

As illustrated by keys 32, 54 in FIG. 2, twelve character keys 51, 52, . . . , 60, 61 in the number key row 11, which are represented by circles in FIG. 1, are elevated with respect to the home keys 29, 30, 31, 32, 35, 36, 37, 38 in the home key row 13 to allow fingers resting on the said home keys 29, 30, 31, 32, 35, 36, 37, 38 in the home key row 13 to reach the said character keys 51, 52, . . . , 61, 62 in the number key row 11 easily. The said character keys 51, 52, . . . , 61, 62 in the number key row 11 are slightly inclined with respect to the base of the machine to which the keyboard is attached, and are tangent to a common inclined plane that slopes down toward the operator to allow the said character keys in the number key row 11 to be operated by sight. This is desirable because of the irregular spacial relation and the large distance separating the said character keys 51, 52, . . . , 61, 62 in the number key row 11 from the said home keys 29, 30, 31, 32, 35, 36, 37, 38 in the home key row 13, which makes it difficult to operate the said character keys 51, 52, . . . , 61, 62 in the number key row 11 without visual cues.

An important feature of this invention is the use of a single elevated case shift key 17 to generate upper case characters. As illustrated in FIG. 1, the said case shift key 17 is situated at the left hand end of the lower letter key row 14. As illustrated by FIGS. 2, 4, 5, 6, the height of the said case shift key 17 is greater than the height of character keys 18, 19, . . . , 61, 62 in the lower letter key row 14, the home key row 13, the upper letter key row 12, and the number key row 11, when the said heights are measured by the vertical distance separating the center of the said key tops from the base of the machine to which the keyboard is attached.

Figure 6:
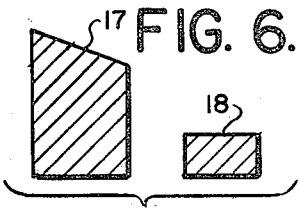
FIG. 6 is a cross-section taken along the line 6—6 of FIG. 1, illustrating the relative height of the case shift key and the adjacent character key in the lower letter key row.

When the bent fingers of the left hand rest on their respective home keys 21, 29, 30, 31, 32 on the left hand side of the keyboard, the elevated case shift key 17 lies under the joint next to the palm of the little finger of the left hand, as illustrated in FIG. 6. This permits the said elevated case shift key 17 to be operated by the left hand without removing fingers of the left hand resting on the same home keys 21, 29, 30, 31, 32 by rotating the palm of the left hand in a counter-clockwise direction, which depresses the joint next to the palm of the little finger of the left hand to actuate the said case shift key 17.

Using a single elevated case shift key 17 is valuable on German keyboards because all nouns in German are capitalized. Employing a single case shift key 17 on ten-finger keyboards reduces the training needed to learn to produce capitals, because the same case shift key 17 is actuated for all upper case characters. This contrasts with the universal ("qwerty") keyboard, where two separate case shift keys are employed situated at opposite ends of the lower letter key row on the standard keyboard, which requires operators to associate a capital letter with a case shift key situated on the opposite side of the keyboard.

As illustrated by keys 29, 65 in FIGS. 1, 4, the case shift lock key 65 is situated at the left hand end of the home key row 13 and is steeply inclined with respect to the base of the machine to which the keyboard is attached, and the said case shift lock key 65 faces the adjacent character key 29 in the home key row 13.

Figure 12:
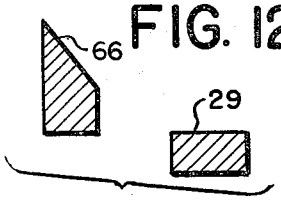
FIG. 12 is a cross-section taken along the line 12—12 of FIG. 1, illustrating the stroking surfaces and relative height of the tabulator key and the character key situated at the left hand end of the home key row.

As illustrated by keys 29, 66 in FIGS. 1, 12, the tabulator key 66 is situated at the left hand end of the upper letter key row 12 and is steeply inclined with respect to the base of the machine to which the keyboard is attached, and the said tabulator key 66 faces character key 29 in the home key row 13. This permits the said tabulator key 66 to be actuated easily by obliquely straightening the little finger of the left hand resting on home key 29 in the home key row 13.

Figure 7:
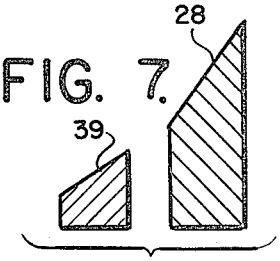
FIG. 7 is a cross-section taken along the line 7—7 of FIG. 1, illustrating the relative height of the stroking surface of the carriage return key and the adjacent character key in the home key row.

As illustrated in FIG. 1, the elevated stroking surface 64 of the carriage return key 28 is situated at the right hand ends of the lower letter key row 14 and the home key row 13. As illustrated by FIGS. 2, 3, 4, 5, 6, 7, 8, the height of the said stroking surface 64 is greater than the height of character keys 18, 19, . . . , 61, 62 in the lower letter key row 14, the home key row 13, the upper letter key row 12, and the number key row 11, when the said heights are measured by the vertical distance separating the center of the said key tops from the base of the machine to which the keyboard is attached. As illustrated by FIG. 7, the said elevated stroking surface 64 of the said carriage return key 28 is steeply inclined with respect to the base of the the machine to which the keyboard is attached.

When the bent fingers of the right hand rest on their respective home keys 16, 35, 36, 37, 38, the knuckle connecting the two joints of the little finger of the right hand that are closest to the palm lies opposite the stroking surface 64 of the carriage return key 28. This allows the said knuckle to actuate the said stroking surface 64 of the said carriage return key 28 by rotating the right wrist in a clockwise direction without removing the fingers of the right hand from their respective home keys 16, 35, 36, 37, 38.

Figure 8:
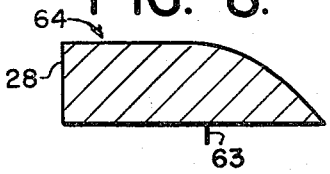
FIG. 8 is a cross-section taken along the line 8—8 of FIG. 1, illustrating the stroking surface of the carriage return key and the connection of the carriage return key to the internal mechanism of the typewriter.

As illustrated in FIGS. 1, 8, the internal connection 63 of the said carraige return key 28 to the machine to which the keyboard is attached is situated at the right hand end of the home key row 13 at the same spacial position employed on the standard electric typewriter.

Figure 9:
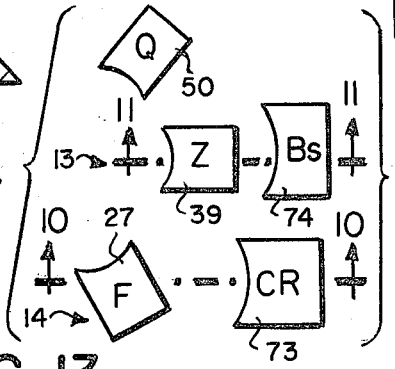
FIG. 9 illustrates an alternate arrangement of control keys on the right hand side of the keyboard bounded by the line 9—9 of FIG. 1.
Figure 10:
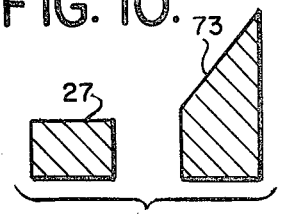
FIG. 10 is a cross-section taken along the line 10—10 of FIG. 9, illustrating the relative height of the carriage return key and the adjacent character key in the lower letter key row.
Figure 11:
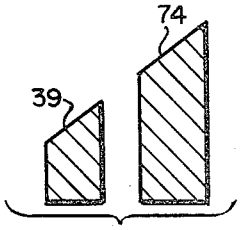
FIG. 11 is a cross-section taken along the line 11—11 of FIG. 9, illustrating the relative height of the backspace key and the adjacent character key in the home key row.

FIG. 9 discloses an alternate arrangement of control keys at the right hand side of the keyboard bounded by the line 9—9 in FIG. 1. The elevated carriage return key 73 is situated at the right hand end of the lower letter key row 14, and the elevated backspace key 74 is situated at the right hand end of the home key row 13. As illustrated in FIG. 10, the height of the said carriage return key 73 is greater than the height of the adjacent character key 27 in the lower letter key row 14. As illustrated in FIG. 11, the height of the said backspace key 74 is greater than the height of the adjacent character key 39 in the home key row 13. This alternate arrangement of the said carriage return key 73 and the said backspace key 74 is advantageous in word processing equipment where stroking errors may be corrected by backstroking.

Figure 13:
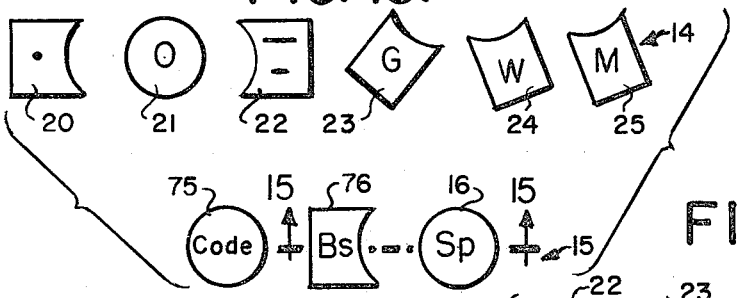
FIG. 13 is a top view of part of the keyboard for word processing equipment lying within the area bounded by line 13—13 of FIG. 1, illustrating the location of the code key and the backspace key in the space bar row.

On word processing equipment, control instructions are often transmitted by depressing a code key and then actuating a character key. Consequently it is desirable when the ten-finger keyboard is utilized on such equipment to be able to depress the control key without removing other fingers resting on home keys. As illustrated in FIG. 13, this is accomplished by placing the code key 75 in the key bar row 15, situated between the operator and keys 21 and 22 in the lower letter key row 14. This permits the said control key 75 to be actuated by bending the left thumb toward the palm while the other fingers of the left hand rest on their respective home keys 29, 30, 31, 32.

Figure 14:
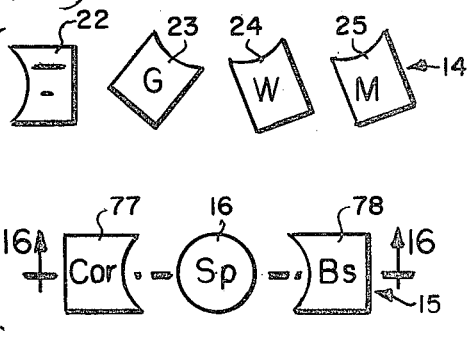
FIG. 14 is a top view of part of the keyboard for correcting typewriters lying with the area bounded by line 14—14 of FIG. 1, illustrating the location of the correction key and the backspace key in the space bar row.
Figure 15:
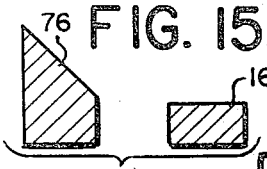
FIG. 15 is a cross-section taken along line 15—15 of FIG. 13, illustrating the steeply inclined stroking surface of the backspace key which faces the space key in the space bar row.

Since stroking errors may be corrected on word processing equipment by backspacing, it is desirable to place the backspace key so that it can be actuated without removing other fingers resting on home keys. As illustrated in FIG. 14 this is accomplished by locating the backspace key 76 in the space bar row 15 next to the space key 16, so that the said backspace key 76 is in the key bar row 15, situated between the operator and keys 22, 23 in the lower letter letter key row 14. As illustrated in FIG. 15, the backspace key 76 possesses a steeply inclined stroking surface that faces the space key 16. This permits the said backspace key 76 to be actuated by extending the right thumb away from the palm while the four other fingers of the right hand rest on their respective home keys 35, 36, 37, 38.

Figure 16:
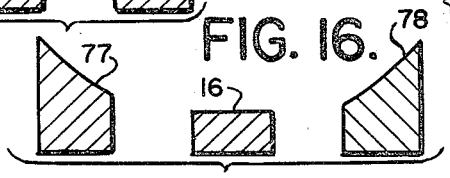
FIG. 16 is a cross-section taken along line 16—16 of FIG. 14, illustrating the steeply inclined stroking surfaces of the correction key and the backspace key which face the space key in space bar row.

When the ten-finger keyboard is utilized on correcting typewriters, it is desirable to be able to actuate the correction key and the backspace key without removing other fingers from home keys. As illustrated in FIG. 14, this is accomplished by setting the correction key 77 and the backspace key 78 on opposite sides of the space key 16 in the space bar row 15, so that the said correction key 77 is located in the space bar row 15 situated between the operator and keys 22, 23 in the lower letter key row 14, and the said backspace key 78 is located in the space bar row 15 situated between the operator and keys 24, 25 in the lower letter key row 14. As illustrated in FIG. 16, the said correction key 77 and the said backspace key 78 possess steeply inclined stroking surfaces that face the space key 16. This allows the said correction key 77 to be actuated by extending the right thumb away from the palm, and the said backspace key 78 to be actuated by bending the right thumb toward the palm while the four other fingers of the right hand rest on their respective home keys 35, 36, 37, 38.

On the keyboards of this invention, the horizontal distance separating the mechanical connection between character keys and the internal mechanism of the machine to which the keyboard is attached is the same for successive character keys in the same key row, as illustrated schematically in FIG. 4 by character 29, 30, 31, 32, 33 in the home key row 13, and the respective connection, 67, 68, 69, 70, 71, of the said character keys to the internal mechanism of the machine. Consequently the stroking surfaces employed on the keyboards of this invention can be readily adapted to existing keyboard devices because the spacial location of the connection between keys and the machine to which the keyboard is attached is the same as the conventional arrangement.

On many contemporary keyboards, character key tops lie in a common inclined plane that slopes down toward the operator. Since character keys 18, 19, 20, 22, 23, . . . , 26, 27, 33, 34, 39, 40, . . . , 49, 50 possessing steeply inclined stroking surfaces (represented in FIG. 1 by rectangular boxes with curved arcs) are connected to the machine at the same spacial position as the standard keyboard, the steeply inclined stroking surfaces of the said character keys 18, 19, 20, 22, 23, . . . , 26, 27, 33, 34, 39, 40, . . . , 49, 50 may be supplied by keys possessing a steeply inclined stroking surface at one end, and a conventional connection to the internal mechanism of the machine at the opposite end. Similarly, the elevated stroking surfaces of the case shift key 17 and the carriage return key 28 and the steeply inclined stroking surfaces of the shift lock key 65 and the tabulator key 66 may be supplied by a simple modification of the plastic keys used on the standard keyboard.

DESIGN PRINCIPLES

To minimize finger motion on the keyboards of this invention, ten common characters consisting of five high frequency consonants, four high frequency vowels, and the space separating words (produced by actuating the space key), are assigned to ten home keys 16, 21, 29, 30, 31, 32, 35, 36, 37, 38 that lie directly under the ten fingers. To utilize the greater dexterity of the right hand, more keystrokes are alloted to the right hand than to the left hand. Home key characters are arranged to maximize the number of successive strokes executed by the same hand, and to maximize the number of successive strokes executed by adjacent fingers of the same hand. This arrangement differs from previous keyboards, such as the Dvorak keyboard disclosed in U.S. Pat. No. 2,040,248 and the curvilinear keyboards disclosed in U.S. Pat. Nos. 3,929,216 and 3,945,482, which maximize the number of successive keystrokes executed by opposite hands by placing vowels and consonants on opposite sides of the keyboard.

Experimental study reveals that it is easier to learn to stroke successive character keys on the same side of the keyboard than to learn to stroke successive character keys situated on opposite sides of the keyboard. This is presumably due to the physiological fact that each hand is controlled by the opposite side of the brain. Thus it is easier to learn to stroke quickly a sequence of characters occurring on home keys on the same side of the keyboard than to learn to stroke quickly a sequence of characters occurring on home keys on alternate sides of the keyboard. This may explain why it has never been established experimentally that the Dvorak keyboard, which maximizes the number of successive keystrokes on oppsite sides of the keyboard, can be learned more rapidly than the standard keyboard.

LINGUISTIC STATISTICS

The ten-finger keyboards of this invention utilize a letter arrangement that is based on the frequency that individual letters and successive pairs of letters (digraphs) occur in natural language texts. It is a fundamental principle of information theory that has been verified empirically (and is used in cryptographic analysis) that the relative frequencies of individual letters and digraphs are characteristic of each language and are substantially the same for any sample of ordinary prose, provided the sample is large enough (100,000 letters) to minimize statistical fluctuations. The frequency of specific letters is characteristic of each language because natural languages consist of information bearing sequences of letters, and random sequences do not contain any information.

A more detailed discussion of linguistic statistics is presented in U.S. Pat. No. 3,929,216, which records the single letter frequencies and digraph frequencies for the English language and the frequencies of common letters in other languages. English digraph frequencies may also be found in U.S. Pat. No. 3,945,482, and these two patents are cited as references.

Since upper-case and lower-case forms of a letter are assigned to the same character key, upper and lower case letters are treated as equivalent in compiling linguistic statistics for application to typewriter keyboards.

When the frequencies of letters are ranked according to their occurrence in natural language texts, the resulting frequency distributions are roughly similar for different European languages, even though the frequency of individual letters varies from language to language.

For the English language: the ranked order of vowels is E (13.1%), A (8.2%), O (7.3%), I (7.5%), U (2.8%), and Y (1.8%); and the ranked order of consonants is T (9.7%), N (7.3%), S (6.6%), R (6.3%), H (5.6%), L (4.2%), D (3.9%), C (3.3%), M (2.6%), F (2.4%), P (2.2%), G (2.0%), W (1.9%), B (1.5%), V (0.8%), K (0.5%), J (0.2%), X (0.2%), Q (0.1%), and Z (0.1%). The percentages in parentheses in this paragraph and succeeding paragraphs refer to the percentage of occurrence of a given letter out of all the letters (omitting the space, punctuation marks, digits, and other symbols) in natural language texts.

For the patent claims of this invention for English language keyboards: the high frequency vowels are defined as E, A. O, and I; the high frequency consonants are defined as T, N, S, and H; and the medium frequency consonants are defined as L, D, C, M, F, P, G, W, and B.

For the German language: the ranked order of vowels is E (16.6%), I (8.0%), A (5.4), U (3.8%), O (2.4%), Ä (0.6%), Ü (0.6%), Ö (0.3%), and Y (0.1%); and the ranked order of consonants is N (10.1%), R (7.2%), S (7.0%), T (6.0%), D (5.0%), H (4.6%), L (3.7%), G (3.1%), C (3.0%), M (2.6%), B (2.0%), F (1.6%), K (1.5%), W (1.5%), Z (1.2%), P (0.9%), V (0.9%), β (0.3%), J (0.2%), Y (0.1%), Q (<0.1%), and X (<0.1%).

For the patent claims of this invention for German language keyboards: the high frequency vowels are defined as E, I, A, and U; the high frequency consonants are defined as N, R, S, T, D, and H; and the medium frequency consonants are defined as C, M, B, F, K, W, P, and V.

THE ENGLISH LANGUAGE KEYBOARD

The character arrangement for the English language keyboard is illustrated in FIG. 1. The space key 16 is assigned to the right thumb. The four high frequency letters T, H, E, S are assigned to four adjacent home keys 35, 36, 37, 38, respectively, on the right hand side of the home key row 13, stroked by the forefinger, the middle finger, the ring finger, and the little finger of the right hand, respectively. This permits the commonest word in English ("the") to be produced by a simple motion of adjacent fingers of the right hand. The T and H are assigned to adjacent home keys 35, 36, respectively, stroked by the forefinger and the middle finger, respectively, to permit medium frequency consonants to be assigned to the dexterous forfinger and middle finger of the right hand. The E is assigned to home key 37 stroked by the ring finger, and the S is assigned to home key 38 stroked by the little finger to increase the number of strokes executed by adjacent fingers because the H and the E, and the S and the E often combine in English words.

The four high frequency letters I, R, A, N are assigned to four adjacent home keys 29, 30, 31, 32, respectively, on the left hand side of the home key row 13 stroked by the little finger, the ring finger, the middle finger, and the forefinger of the left hand, respectively. The N is assigned to home key 32 stroked by the left forefinger, and the R is assigned to home key 30 stroked by the left ring finger, because the N occurs more often than the R. The A is assigned to home key 31 stroked by the left middle finger, and the I is assigned to home key 29 stroked by the left little finger, because the R combines more often with the A than with the I in English words. The medium frequency vowel U is assigned to key 42 in the upper letter key row 12, stroked by the left middle finger, to facilitate stroking common digraphs containing U and R or the N, which are assigned to home keys stroked by adjacent fingers of the left hand. The high frequency vowel O is assigned to home key 21 in the lower letter key row 14, stroked by the left thumb to facilitate stroking the common digraphs on, or, ou, and the common trigraph ion.

Since medium frequency consonants often combine with vowels, they are assigned to fingers that stroke high frequency consonants rather than high frequency vowels. Medium frequency consonants are assigned to keys to minimize the number of successive keystrokes executed by the same finger. As far as possible, medium frequency consonants are assigned to maximize the number of successive keystrokes executed by fingers of the same hand involving non-home keys.

On the left hand side of the keyboard in the upper letter key row 11: the Y is assigned to key 40 stroked by the little finger because the Y rarely combines with the I; the C is assigned to key 41 stroked by the ring finger because the C does not combine often with the R; and the L is assigned to key 43 because the L rarely combines with the N.

On the right hand side of the keyboard: the G, W, P and B are assigned to keys 23, 24, 34, 46, respectively, stroked by the forefinger because the G, W, P, and B rarely combine with the T stroked by the forefinger. The M and D are assigned to key 25, 47, respectively, stroked by the middle finger, because the M and D rarely combine with the H, and frequently combine with the E assigned to key 37 stroked by the adjacent ring finger. The F and V are assigned to keys 27, 49, respectively, stroked by the little finger becuase the F and V rarely combine with the S stroked by the little finger and the V frequently combines with the E.

The low frequency consonants X and Z are assigned to keys 33, 39, respectively, in the home key row 13, and the low frequency consonants J, K, Q are assigned to keys 44, 45, 50, respectively, in the upper letter key row 12 that are more difficult to stroke than the keys assigned medium frequency consonants enumerated in the preceding paragraph.

The period is assigned to key 20 in the lower letter key row 14 and the comma is assigned to key 48 in the upper letter key row 12 because these keys are easy to stroke. Other punctuation marks that occur relatively often—apostrophe, semi-colon and hyphen, underline are assigned to keys 19, 22, respectively, that are relatively easy to stroke. Rarer punctuation marks—question mark, exclamation point and double quotation marks, colon are assigned to keys 18, 26, respectively, that are harder to stroke.

The digits one through nine are assigned in serial order in lower case positions to keys 51, 52, . . . , 58, 59 in the number key row 11, and the zero is assigned to key 60 in the number key row 11 in the same position employed for number keys on the standard keyboard. Characters assigned upper case positions on the digit keys may be the same as those assigned to identical digit keys on the standard "qwerty" keyboard; and characters such as the slash, brackets, and ½ may be assigned to keys 61, 62.

On the English language keyboards of this invention, 75% of the single keystrokes and 54% of the successive keystrokes occur on the ten home keys. Of the single home keystrokes, 45% are executed by the right hand, and 30% are executed by the left hand. More keystrokes are executed by the more dexterous right hand than the left hand, and a majority of single keystrokes and successive keystrokes occur on home keys operated by the same hand. Of successive home keystrokes, 23% are executed by the opposite hands, 31% are executed by the same hand: 22% by the right hand and 9% by the left hand.

If high frequency characters were randomly distributed on home keys, the same number of single keystrokes would be executed by the right hand and the left hand, and the same number of successive keystrokes would occur on the same hand as on opposite hands. On the English language keyboards of this invention, however, the right hand executes 50% more keystrokes than the left hand, and the same hand executes 33% more successive keystrokes than opposite hands. This concentration of right hand keystrokes and successive keystrokes by the same hand leads to faster learning and increases typing speeds on the keyboards of this invention, because nine out of ten operators are right-handed.

THE GERMAN LANGUAGE KEYBOARD

Figure 17:
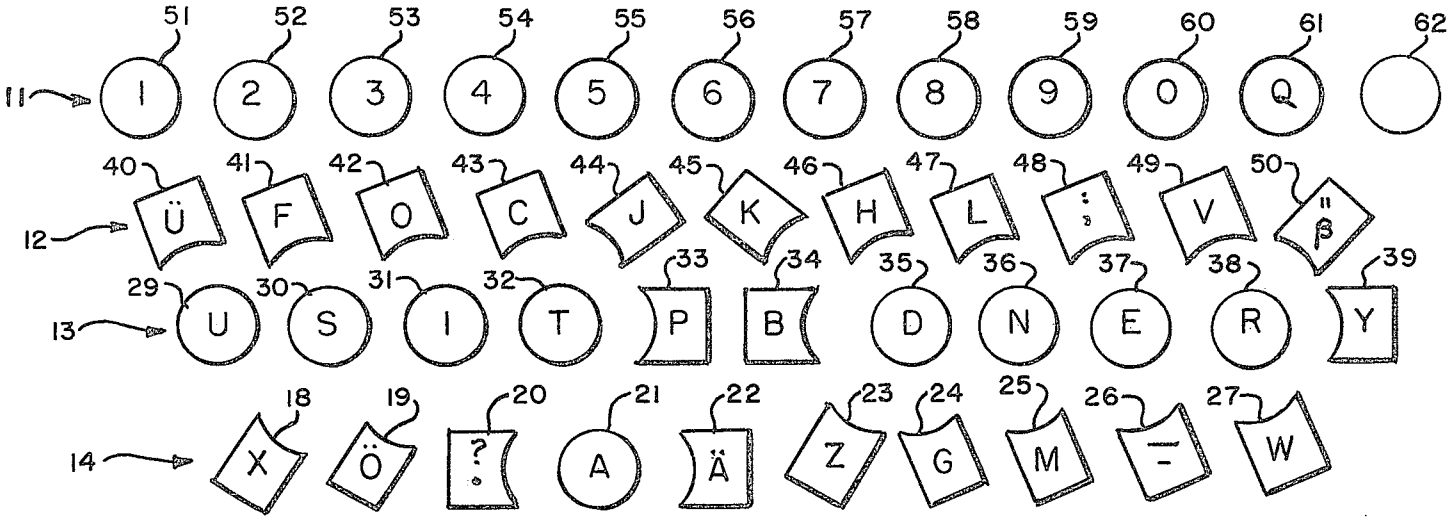
FIG. 17 is a top view of part of the ten-finger keyboard for the German language, illustrating the location of the most important characters.

The character arrangement for the German language keyboard is illustrated in FIG. 17. Characters are arranged in accordance with the principles employed for the English keyboard taking into account the statistical behavior of character sequences in German texts.

On the right hand side of the keyboard, the commonest consonant N is assigned to home key 36, stroked by the middle finger, and the commonest vowel E is assigned to home key 37, stroked by the ring finger. This permits digraphs containing e and n, which occur often, to be stroked by adjacent fingers. The D is assigned to home key 35 stroked by the forefinger to permit to the common digraph nd to be stroked by adjacent fingers. The R is assigned to home key 38 stroked by the little finger because the r terminates many German words and often combines with the e stroked by the adjacent ring finger.

The G is assigned to key 31 to facilitate producing the common digraph ng. The Z, B, K, H are assigned to keys 23, 34, 45, 46, respectively, stroked by the forefinger because the Z, B, K, H rarely combine with each other or with the D stroked by the forefinger. Likewise the M and L are assigned to keys 25, 47, respectively, stroked by the middle finger, because the M and L rarely combine with each other or with the N stroked by the middle finger. Similarly, the W and V are assigned to keys 27, 49 stroked by the little finger because the W and V rarely combine with each other or with the R stroked by the little finger.

The lower case, comma, upper case, colon is assigned to key 48 stroked by the ring ringer, while rarer letters and rarer punctuation marks are assigned to character keys that are more difficult to actuate. Thus the Y is assigned to key 39, the lower case hyphen, upper case, underline is assigned to key 26, and the lower case, β, upper case, double quotation marks, is assigned to key 50. The rare consonant Q, which occurs less than once per thousand letters (principally in words of foreign origin) is assigned to key 61 in the number key row 11. Assigning the Q to key 61 in the number key row 11 permits punctuation marks that occur more often to be assigned to character keys outside the number key row 11 that are easier to actuate than character keys in the number key row 11.

On the left hand side of the German keyboard, the vowel U is assigned to home key 29 stroked by the little finger because the U (3.9%) occurs less frequently than the vowels A (5.4%) and I (8.0%) assigned to other home keys. The A is assigned to home key 21 stroked by the left thumb to facilitate producing the common digraph au. The I is assigned to home key 31 stroked by the middle finger, the S is assigned to key 30 stroked by the ring finger, and the T is assigned to key 32 stroked by the forefinger. This assignment creates a pattern of alternating high frequency vowels and consonants on the left hand of the home key row 13, which maximizes the number of digraphs stroked by adjacent fingers of the left hand resting on their respective home keys.

The C is assigned to key 43 to permit the common German digraph ch to be stroked by the forefingers of the right and left hands, and to facilitate producing the common German trigraphs sch and cht. The P and J are assigned to keys 33, 34, respectively, stroked by the left forefinger because the P and J rarely combine with each other or with the T stroked by the left forefinger. Likewise the F is assigned to key 41 stroked by the ring finger because the F rarely combines with the S stroked by the ring finger. The O is assigned to key 42 to create a pattern of alternating vowels and consonants on the left hand side of the upper letter key row 12. This arrangement facilitates producing common digraphs involving a pair key of character keys on the left hand side of the upper letter key row 12.

Vowels with umlauts are assigned to keys that are stroked by the same fingers as the identical vowel without the umlaut. Thus the Ö, Ä, Ü are assigned to keys 19, 22, 40, respectively, so that vowels with the umlaut will be stroked by the same finger as the identical vowel without the umlaut. This arrangement makes it easier to learn the location of character keys containing umlaut vowels.

The lower case period, upper case, question mark is assigned to key 20 stroked by the left thumb. The rare letter X is assigned to key 18 which is more difficult to actuate than keys assigned medium frequency letters.

I claim:

1. An English language keyboard for typewriters, CRT terminals, and word processing equipment, comprising a plurality of character keys arranged in straight parallel key rows transversely oriented with respect to the operator:

wherein a number key row is situated at the greatest distance from the operator, an upper letter key row is situated between the number key row and the operator, a home key row is situated between the upper letter key row and the operator, and a lower letter key row is situated between the home key row and the operator;

wherein character keys in each key row are designated in serial order from the left hand side of the keyboard to the right hand side of the keyboard as viewed by the operator, with the character key at the left hand end of a given key row being designated as the first key, and the character key at the right hand end of a given key row being designated as the highest numbered key in the said key row, as viewed by the operator;

wherein upper and lower case forms of a letter are assigned to the same character key;

wherein letters are assigned to the said character keys in key rows from left to right as viewed by the operator as follows:

in the lower letter key row: O assigned to the fourth key; and in the home key row: I assigned to the first key, R assigned to the second key, A assigned to the third key, N assigned to the fourth key, T assigned to the seventh key, H assigned to the eighth key, E assigned to the ninth key, and S assigned to the tenth key.

2. A keyboard for the English language, as in claim 1, comprising letters assigned to the said character keys in key rows from left to right as viewed by the operator:

in the lower letter key row: W assigned to the seventh key, M assigned to the eighth key, and F assigned to the tenth key; and in the upper letter key row: C assigned to the second key, L assigned to the fourth key, B assigned to the seventh key, and D assigned to the eighth key.

3. A keyboard for the English language, as in claim 2, comprising characters assigned to the said character keys in key rows from left to right as viewed by the operator:

in the lower letter key row: lower case, question mark, upper case, exclamation point assigned to the first key, lower case, apostrophe, upper case, semicolon assigned to the second key, period assigned to the third key, O assigned to the fourth key, lower case, hyphen, upper case, underline assigned to the fifth key, G assigned to the sixth key, W assigned to the seventh key, M assigned to the eighth key, lower case, double quotation marks, upper case, colon assigned to the ninth key, and F assigned to the tenth key;

in the home key row: I assigned to the first key, R assigned to the second key, A assigned to the third key, N assigned to the fourth key, X assigned to the fifth key, P assigned to the sixth key, T assigned to the seventh key, H assigned to the eighth key, E assigned to the ninth key, S assigned the tenth key, and Z assigned to the eleventh key; and in the upper letter key row: Y assigned to the first key, C assigned to the to the second key, U assigned to the third key, L assigned to the fourth key, J assigned to the fifth key, K assigned to the sixth key, B assigned to the seventh key, D assigned to the eighth key, comma assigned to the ninth key, V assigned to the tenth key, and Q assigned to the eleventh key.

4. A German language keyboard for typewriters, CRT terminals, and word processing equipment, comprising a plurality of character keys arranged in straight parallel key rows transversely oriented with respect to the operator:

wherein a number key row is situated at the greatest distance from the operator, an upper letter key row is situated between the number key row and the operator, a home key row is situated between the upper letter key row and the operator, and a lower letter key row is situated between the home key row and the operator;

wherein character keys in each key row are designated in serial order from the left hand side of the keyboard to the right hand side of the keyboard as viewed by the operator, with the character key at the left hand end of a given key row being designated as the first key, and the character key at the right hand end of a given key row being designated as the highest numbered key in the said key row, as viewed by the operator;

wherein upper and lower case forms of a letter are assigned to the same character key;

wherein letters are assigned to the said character keys in key rows from left to right as viewed by the operator as follows:

in the lower letter key row: A assigned to the fourth key; and in the home key row: U assigned to the first key, S assigned to the second key, I assigned to the third key, T assigned to the fourth key, D assigned the seventh key, N assigned to the eighth key, E assigned to the ninth key, and R assigned to the tenth key.

5. A keyboard the the German language, as in claim 4, comprising letters assigned to the said character keys in key rows from left to right as viewed by the operator:

in the lower letter key row: G assigned to the seventh key, M assigned to the eighth key, and W assigned to the tenth key; and in the upper letter key row: F assigned to the second key, C assigned to the fourth key, H assigned to the seventh key, and L assigned to the eighth key.

6. A keyboard for the German language, as in claim 5, comprising characters assigned to the said character keys in key rows from left to right as viewed by the operator:

in the lower letter key row: X assigned to the first key, Ö assigned to the second key, lower case, period, upper case, question mark assigned to the third key, A assigned to the fourth key, Ä assigned to the fifth key, Z assigned to the sixth key, G assigned to the seventh key, M assigned to eighth key, lower case, hyphen, upper case, underline assigned to the ninth key, and W assigned to the tenth key in the home key row: U assigned to the first key, S assigned to the second key, I assigned to the third key, T assigned to the fourth key, P assigned to the fifth key, B assigned to the sixth key, D assigned to the seventh key, N assigned to the eighth key, E assigned to the ninth key, R assigned to the tenth key, and Y assigned to the eleventh key;

in the upper letter key row: Ü assigned to the first key, F assigned to the second key, O assigned to the third key, C assigned to the fourth key, J assigned to the fifth key, K assigned to the sixth key, H assigned to the seventh key, L assigned to the eighth key, lower case, comma, upper case, colon assigned to the ninth key, V assigned to the tenth key, and lower case, β, upper case, double quotation marks assigned to the eleventh key; and in the number key row; Q assigned to the eleventh key.

7. A keyboard comprising a plurality of character keys arranged in straight parallel key rows transversely oriented with respect to the operator:

wherein a number key row is situated at the greatest distance from the operator, an upper letter key row is situated between the number key row and the operator, a home key row is situated between the upper letter key row and the operator, a lower letter key row is situated between the home key row and the operator, and a space bar row is situated between the lower letter key row and the operator;

wherein character keys in each key row are designated in serial order from the left hand side of the keyboard to the right hand side of the keyboard, as viewed by the operator, with the character key at left hand end of a given key row being designated as the first key, and the character key at the right hand end of a given key row being designated as the highest number key in the said key row, as viewed by the operator;

wherein a space key is situated on the right hand side of the space bar row, as viewed by the operator, between the sixth and seventh keys in the lower letter key row and the operator;

wherein the height of character key tops are measured by the vertical distance separating the center of said key tops from the base of the machine to which the keyboard is attached;

wherein character key tops in the number key row have the same height;

wherein character key tops of the first key, the fourth key, the seventh key, and the ninth key in the home key row have the same height;

wherein character key tops of the second key, the third key, the eighth key, and the ninth key in the home key row have the same height;

wherein character key tops in the number key row are slightly inclined with respect to the base of the machine to which the keyboard is attached and face the operator, and are situated in a common inclined plane that slopes down toward the operator, wherein the key tops of the space key in the space bar row, the fourth key in the lower letter key row, and the first key, the fourth key, the seventh key, and the tenth key in the home key row are slightly inclined with respect to the base of the machine to which the keyboard is attached and face the operator; the said key tops being situated in a common inclined plane that slopes down toward the operator; the said inclined plane being situated between the base of the machine to which the keyboard is attached and an inclined plane that is tangent to the said character key tops in the number key row;

wherein the key tops of the second key, the third key, the eighth key, and the ninth key in the home key row are slightly inclined with respect to the base of the machine to which the keyboard is attached and face the operator; the said key tops being situated in a common inclined plane that is situated between the base of the machine to which the keyboard is attached and an inclined plane that is tangent to key tops of the space key in the space key row, the fourth key in the lower letter key row, and the first key, the fourth key, the seventh key, and the tenth key in the home key row; and wherein other character keys in the lower letter key row have a stroking surface that is steeply inclined with respect to the base of the machine to which the keyboard is attached so that the stroking surface of the first key faces the second key in the home key row, the stroking surface of the second key faces the third key in the home key row, the stroking surface of the third key faces the fourth key in the lower letter key row, the stroking surface of the fifth key faces the fourth key in the lower letter key row, the stroking surface of the sixth key faces the seventh key in the home key row, the stroking surface of the seventh key faces the the seventh key in the home key row, the stroking surface of the eighth key faces the eighth in the home key row, the stroking surface of the ninth key faces the ninth key in the home key row, and the stroking surface of the tenth key faces the tenth key in the home key row.

8. A keyboard, as in claim 7:

wherein other character keys have a stroking surface that is steeply inclined with respect to the base of the machine to which the keyboard is attached;

wherein the said steeply inclined stroking surfaces of the said character keys in the home key row are oriented so that the stroking surface of fifth key faces the fourth key in the home key row, the stroking surface of the sixth key faces the seventh key in the home key row, and the stroking surface of the eleventh key faces the tenth key in the home key row; and wherein the said steeply inclined stroking surfaces of the said character keys in the upper letter key row are oriented so that stroking surface of the first key faces the first key in the home key row, the stroking surface of the second key faces the second key in the home key row, the stroking surface of the third key faces the third key in the home key row, the stroking surface of the fourth key faces the fourth key in the home key row, the stroking surface of the fifth key faces the fourth key in the home key row, the stroking surface of the sixth key faces the seventh key in the home key row, the stroking surface of the seventh key faces the seventh key in the home key row, the stroking surface of the eighth key faces the eighth key in the home key row, the stroking surface of the ninth key faces the ninth key in the home key row, the stroking surface of the tenth key faces the tenth key in the home key row, and the stroking surface of the eleventh key faces the tenth key in the home key row.

9. A keyboard, as in claim 7:

wherein a case shift key is situated at the left hand end of the lower letter key row, a tabulator key is situated at the left hand end of the upper letter key row, a carriage return key is situated at the right hand end of the lower letter key row, and a backspace key is situated at the right hand end of the home key row, as viewed by the operator;

wherein key tops of the said tabulator key and the said backspace key are steeply inclined with respect to the base of the machine to which the keyboard is attached, and the said tabulator key top faces the first character key in the home key row, and the said backspace key top faces the tenth key in the home key row; and wherein the heights of key tops are measured by the vertical distance separating the center of said key tops from the base of the machine to which the keyboard is attached;

wherein the height of the said tabulator key top is greater than the height of character key tops in the home key row, and the height of the said backspace key top is greater than the height of character key tops in the home key row and the upper letter key row; and wherein the heights of the said case shift key top and the said carriage return key top are equal, and are greater than the heights of character key tops in the lower letter key row, the home key row, the upper letter key row, and the number key row.

10. A keyboard, as in claim 7:

wherein a case shift key is situated at the left hand end of the lower letter key row, as viewed by the operator;

wherein a carriage return key has a stroking surface situated at the right hand ends of the lower letter key row and the home key row, as viewed by the operator;

wherein the height of key tops and stroking surfaces are measured by the vertical distance separating the center of the said key tops and the center of the said stroking surfaces from the base of the machine to which the keyboard is attached; and wherein the height of the key top of the said case shift key and the height of the stroking surface of the said carriage return key are greater than the heights of character key tops in the lower letter key row, the home key row, the upper letter key row, and the number key row.

11. A keyboard for word processing equipment, as in claim 7:

wherein a code key is located in the space bar row, situated between the operator and the fourth key and the fifth key in the lower letter key row;

wherein a backspace key is located in the space bar row, situated between the operator and the fifth key and the sixth key in the lower letter key row;

wherein the stroking surface of the said backspace key is steeply inclined with respect to the machine to which the keyboard is attached; and wherein the said stroking surface of the said backspace key faces the space key in the space bar row.

12. A keyboard for correcting typewriters, as in claim 7:

wherein a correction key is located the space bar row, situated between the operator and the fifth key and the sixth key in the lower letter key row;

wherein a backspace key is located in the space bar row, situated between the operator and the seventh key and the eighth key in the lower letter key row;

wherein the stroking surface of the said correction key and the stroking surface of the said backspace key are steeply inclined with respect to the base of the typewriter to which the keyboard is attached; and wherein the said stroking surface of the said correction key and the said stroking surface of the said backspace key face the space key in the space bar row.

* * * * *